US010464121B2

(12) United States Patent
Ferianci et al.

(10) Patent No.: US 10,464,121 B2
(45) Date of Patent: Nov. 5, 2019

(54) DUAL FORGING SYSTEM AND METHOD

(71) Applicant: Eaton Corporation, Cleveland, OH (US)

(72) Inventors: Lucas Santiago Ribeiro Ferianci, Sao Jose dos Campos (BR); Darci Primon Araujo, Sao Jose dos Campos (BR); Marco Antonio Candido, Sao Paulo (BR); Joao Benedito Silva, Sao Jose dos Campos (BR)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/990,621

(22) Filed: May 26, 2018

(65) Prior Publication Data

US 2018/0333767 A1 Nov. 22, 2018

Related U.S. Application Data

(63) Continuation of application No. 14/750,093, filed as application No. PCT/US2013/077061 on Dec. 20, 2013, now Pat. No. 9,981,306.

(Continued)

(51) Int. Cl.

*B21J 5/02* (2006.01)
*B21J 9/08* (2006.01)

(Continued)

(52) U.S. Cl.

CPC . *B21J 5/02* (2013.01); *B21J 1/06* (2013.01); *B21J 9/022* (2013.01); *B21J 9/08* (2013.01); *B21J 13/06* (2013.01); *B21K 27/02* (2013.01)

(58) Field of Classification Search

CPC ..... B21J 5/00; B21J 5/02; B21J 5/008; B21J 5/022; B21J 5/025; B21J 9/02;

(Continued)

(56) References Cited

U.S. PATENT DOCUMENTS 3,772,906 A * 11/1973 Dorton ..... B21J 5/02 72/356
4,444,039 A 4/1984 Asari et al.
6,272,892 B1 * 8/2001 Ozaki ..... B21K 27/04 72/21.3

FOREIGN PATENT DOCUMENTS

JP 2826622 B2 11/1998
JP 2007136534 A 6/2007

(Continued)

OTHER PUBLICATIONS

International Search Report and Written Opinion for International Application No. PCT/US2013/077061 dated Apr. 18, 2014, 12 pages.

*Primary Examiner* — Pradeep C Battula
(74) *Attorney, Agent, or Firm* — RMCK Law Group PLC

(57) ABSTRACT

An apparatus includes an anvil having a first end and second end, and a press head reciprocally mounted relative to the anvil. The apparatus further includes an induction heater having a workpiece discharge end mounted adjacent the first end of the anvil, and a plurality of first station dies secured to the anvil. The first station dies each form at least a portion of a first contour. A plurality of second station dies are also secured to the anvil, the second station dies each defining at least a portion of a second contour.

7 Claims, 21 Drawing Sheets

Related U.S. Application Data

(60) Provisional application No. 61/746,865, filed on Dec. 28, 2012.

(51) Int. Cl.

| | |
|---|---|
| ***B21J 13/06*** | (2006.01) |
| ***B21K 27/02*** | (2006.01) |
| ***B21J 1/06*** | (2006.01) |
| ***B21J 9/02*** | (2006.01) |

(58) Field of Classification Search
CPC ..... B21J 9/022; B21J 9/08; B21J 1/06; B21J 13/06; B21K 27/02; B21K 27/04
See application file for complete search history.

(56) References Cited

FOREIGN PATENT DOCUMENTS

| | | | |
|---|---|---|---|
| JP | 2007253224 | A | 10/2007 |
| WO | 2012043374 | A1 | 4/2012 |

* cited by examiner

DUAL FORGING SYSTEM AND METHOD

CROSS-REFERENCE TO RELATED APPLICATION

This application is a continuation of U.S. patent application Ser. No. 14/750,093 filed on Jun. 25, 2015, which is a continuation of International Patent Application No. PCT/US2013/077061 filed on Dec. 20, 2013, which claims the benefit of U.S. Patent Application No. 61/746,865 filed on Dec. 28, 2012. The disclosures of the above applications are incorporated herein by reference.

FIELD

The present disclosure concerns apparatuses and processes related to forging and forging presses.

BACKGROUND

Forging presses can form parts with a progressive set of forging tooling, such as dies and punches. Workpieces that start as metal slugs pass from forming station to forming station in order, sequentially changing shape. The forged component that emerges from the final station can be processed further, for example by machining or grinding. The number of parts formed at each station is directly dependent on the frequency with which the forging press can complete a cycle of forging a workpiece (e.g., receiving a workpiece in a die, forming the workpiece, and extracting the workpiece from the die).

SUMMARY

In one aspect of the present teachings, an apparatus includes an anvil having a first end and second end, and a press head reciprocally mounted relative to the anvil. The apparatus further includes a plurality of induction heaters each having a workpiece discharge end mounted adjacent the first end of the anvil. A plurality of first station dies are secured to the anvil, the first station dies each forming at least a portion of a first contour. A plurality of second station dies are secured to the anvil, the second station dies each defining at least a portion of a second contour. The apparatus further includes a discharger disposed adjacent the second end of the anvil and having a plurality of workpiece removal arms each operable to selectively engage a workpiece at the second station dies.

In another aspect, an apparatus includes an anvil having a first end and second end, and a press head reciprocally mounted relative to the anvil. The apparatus further includes an induction heater having a workpiece discharge end mounted adjacent the first end of the anvil, and a plurality of first station dies secured to the anvil. The first station dies each form at least a portion of a first contour. A plurality of second station dies are also secured to the anvil, the second station dies each defining at least a portion of a second contour.

In yet another aspect, a method includes inductively heating a plurality of forgeable workpieces, and depositing one of each of the plurality of forgeable workpieces in each of a plurality of first forming stations having a first common die shape. The method further includes, upon depositing the plurality of forgeable workpieces in each of the first stations, applying pressure simultaneously to the plurality workpieces until the plurality of workpieces have a first shape. The method also includes transferring one of each of the plurality of workpieces having a first shape to each of a plurality of second forming stations having a second common die shape. The method further includes, upon depositing one of each of the plurality of forgeable workpieces in each of the second stations, applying pressure simultaneously to the plurality of workpieces until the plurality of workpieces have a second shape.

BRIEF DESCRIPTION OF THE DRAWINGS

In the accompanying drawings, structures and methods are illustrated that, together with the detailed description provided below, describe aspects of a dual forging press and methods of using a dual forging press. It will be noted that a single component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
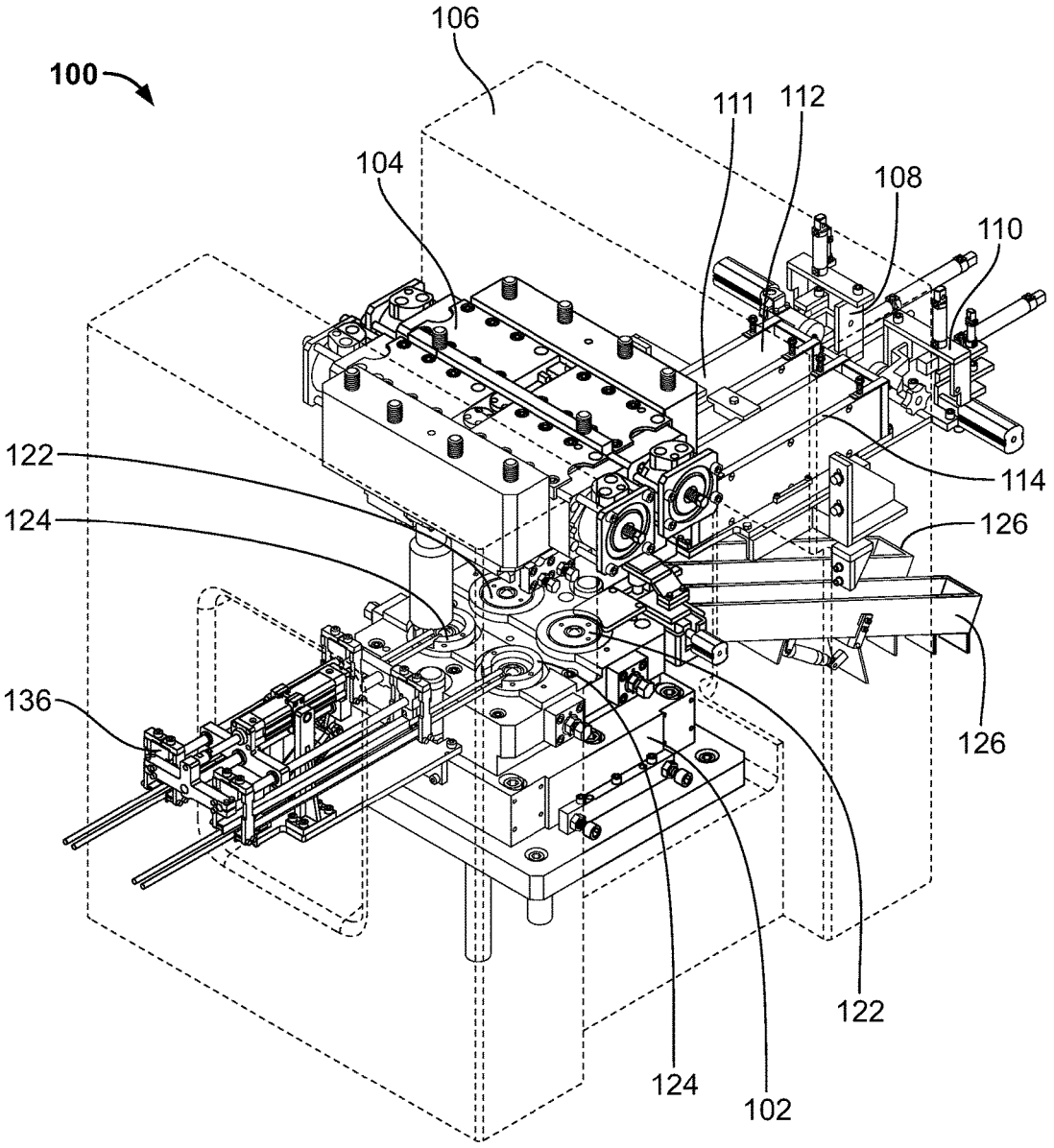
FIG. 1 illustrates a perspective view of a forging press 100 in accordance with the present teachings.

With reference to FIG. 1, a portion of a forging press 100 according to the present disclosure is shown including an anvil 102 and a press head 104 that can move reciprocally relative to the anvil 102, which can be secured to a press housing 106. Induction heater feeder assemblies 108, 110 can receive workpieces in the form of metal slugs, and supply the workpieces to an induction heaters assembly 111, which can include induction heaters 112, 114. The induction heater assembly 111 can be secured to a housing 116.

Upon heating by the induction heaters 112, 114, the workpieces can be provided to a die feeder 118. As described further herein, the feeder 118 can move the workpieces to the two first station dies 122, 124. The feeder 118 can also divert workpieces that do not achieve sufficient temperatures or rise to undesirably high temperatures to sorters 126.

Figure 2:
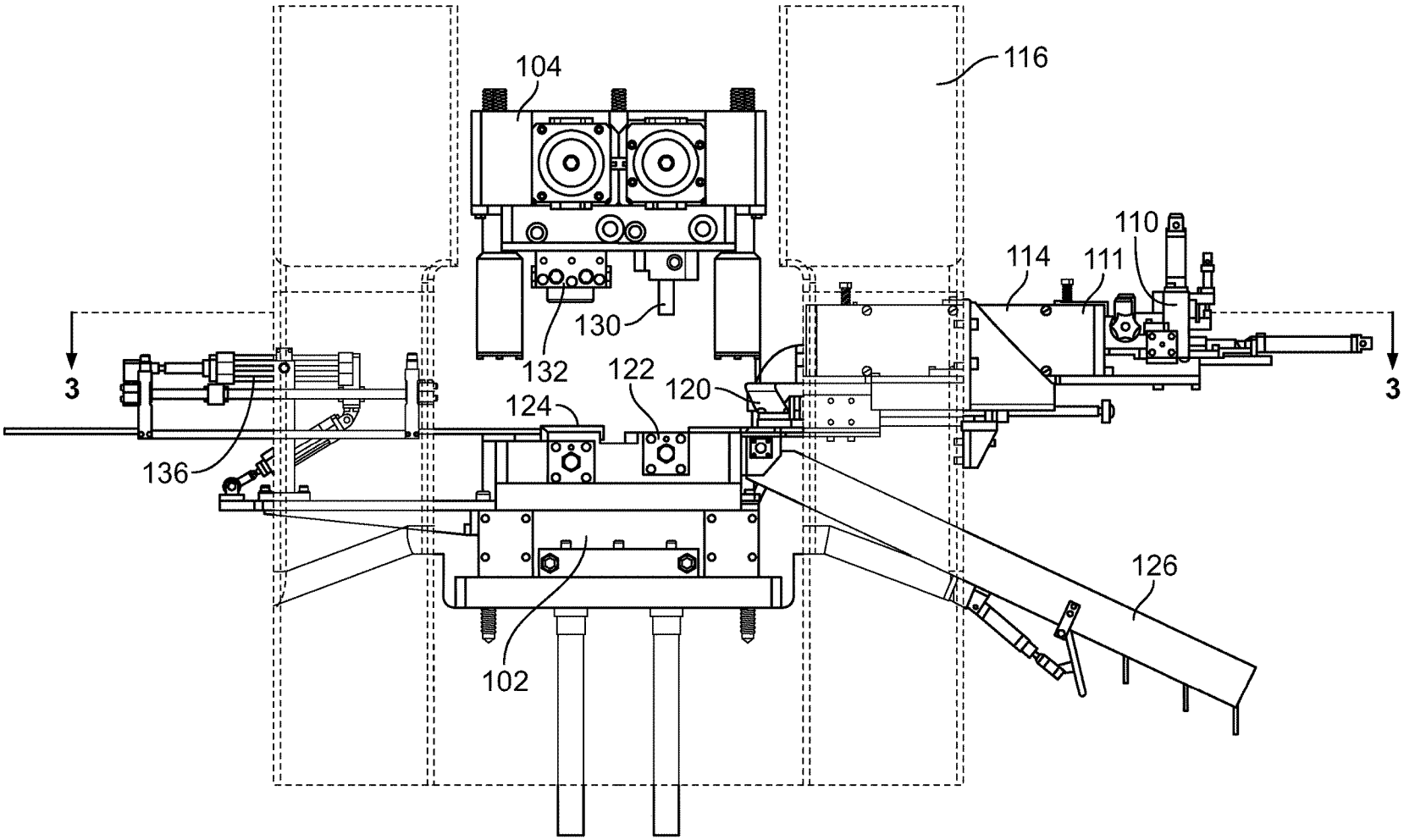
FIG. 2 illustrates an elevation view of the forging press 100 shown in FIG. 1.
Figure 3:
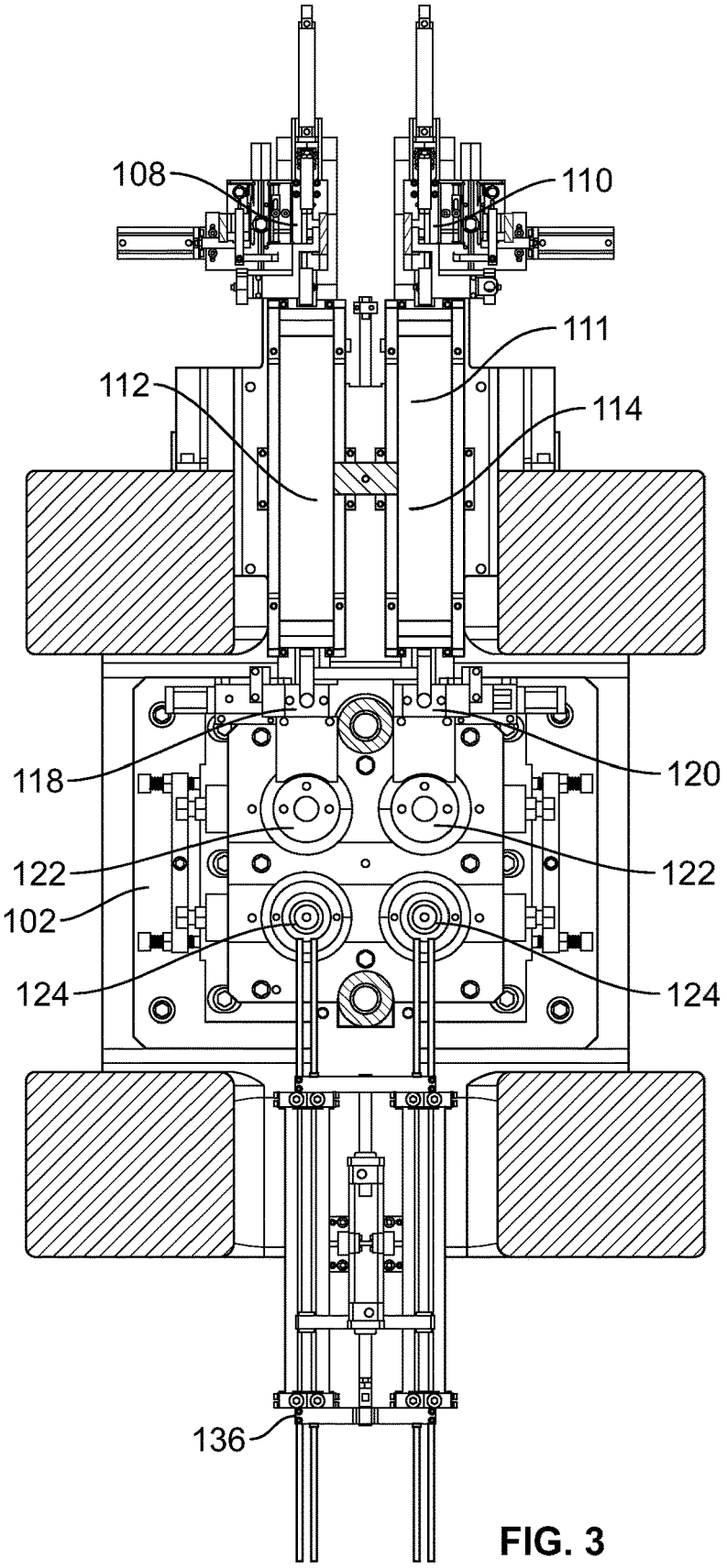
FIG. 3 illustrates a sectional view of a forging press 100 along the line 3-3 shown in FIG. 2.

Once the first station dies 122, 124 are supplied with workpieces, the press head 104 can descend upon the anvil 102. As shown in FIG. 2, forming pins 130, 132 can be positioned above the first station dies 122, 124. When the press head 104 descends, the forming pins 130, 132 can apply pressure to the heated workpiece, can deform the workpieces, and can force the workpieces to take on the shape of the mold formed by first station dies 122, 124.

Figure 4:
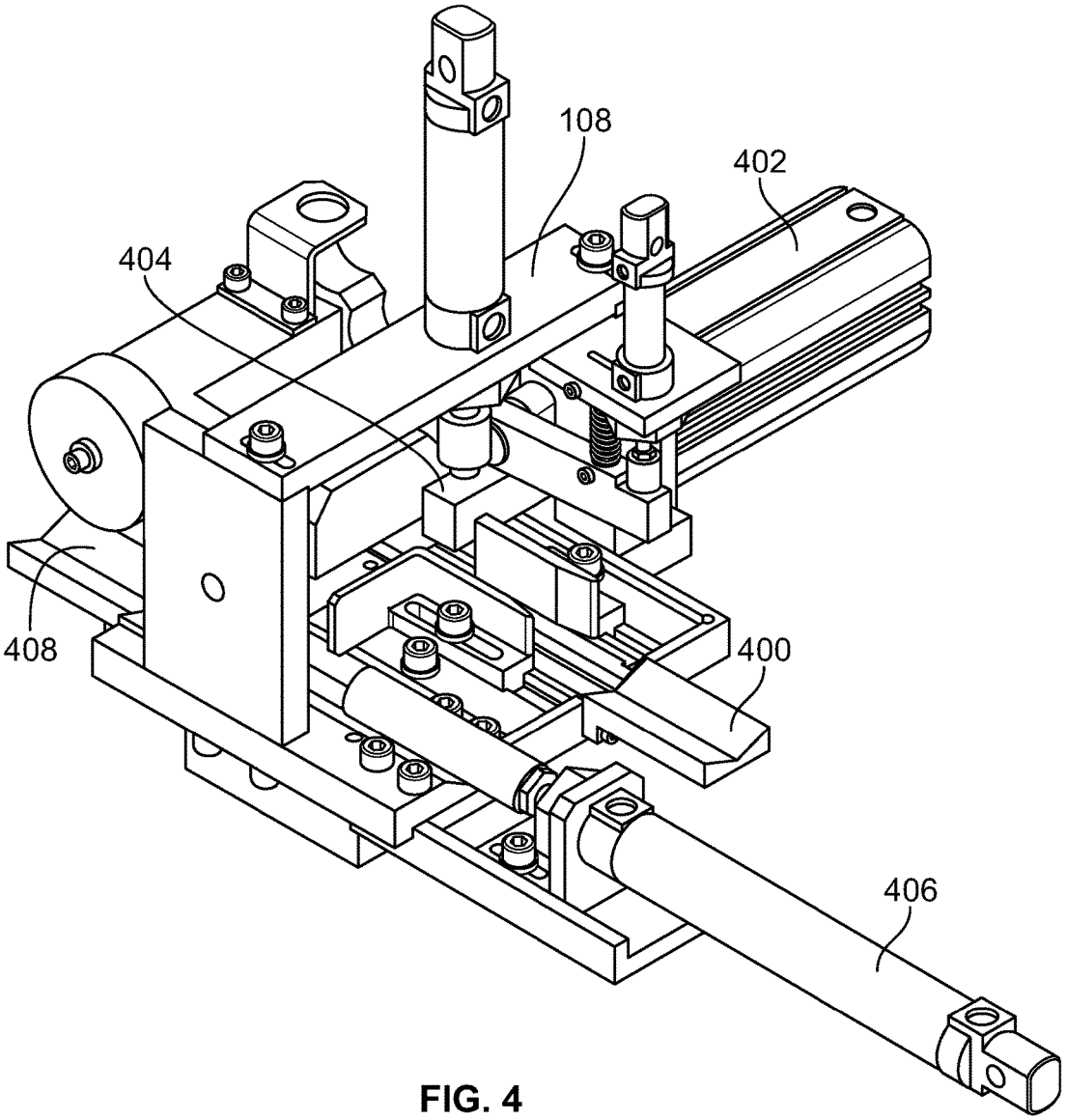
FIG. 4 illustrates a perspective view of an inductor heater feeder 108 in accordance with the present teachings.
Figure 5:
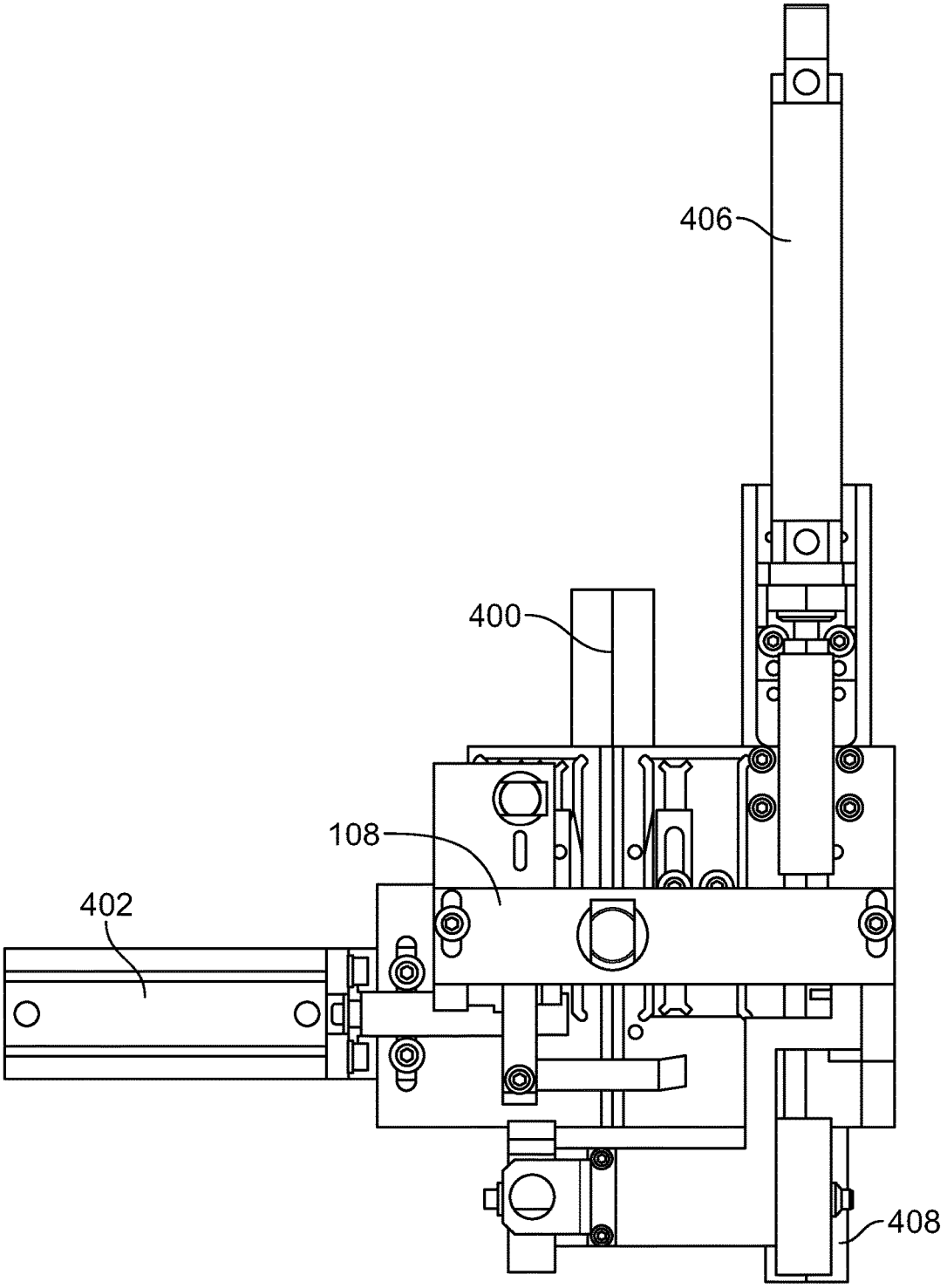
FIG. 5 illustrates a plan view of the induction heater feeder 108.

With reference to FIGS. 4 and 5, the induction heater feeder 108 can have a tray 400 that receives workpieces. An actuator 402 can have an arm 404 that can move the workpieces in a position where another actuator 406 can move the workpiece toward another tray 408 that for example can feed the induction heater 112. The second induction heater feeder 110 can be a mirror image of the feeder 108.

Figure 6:
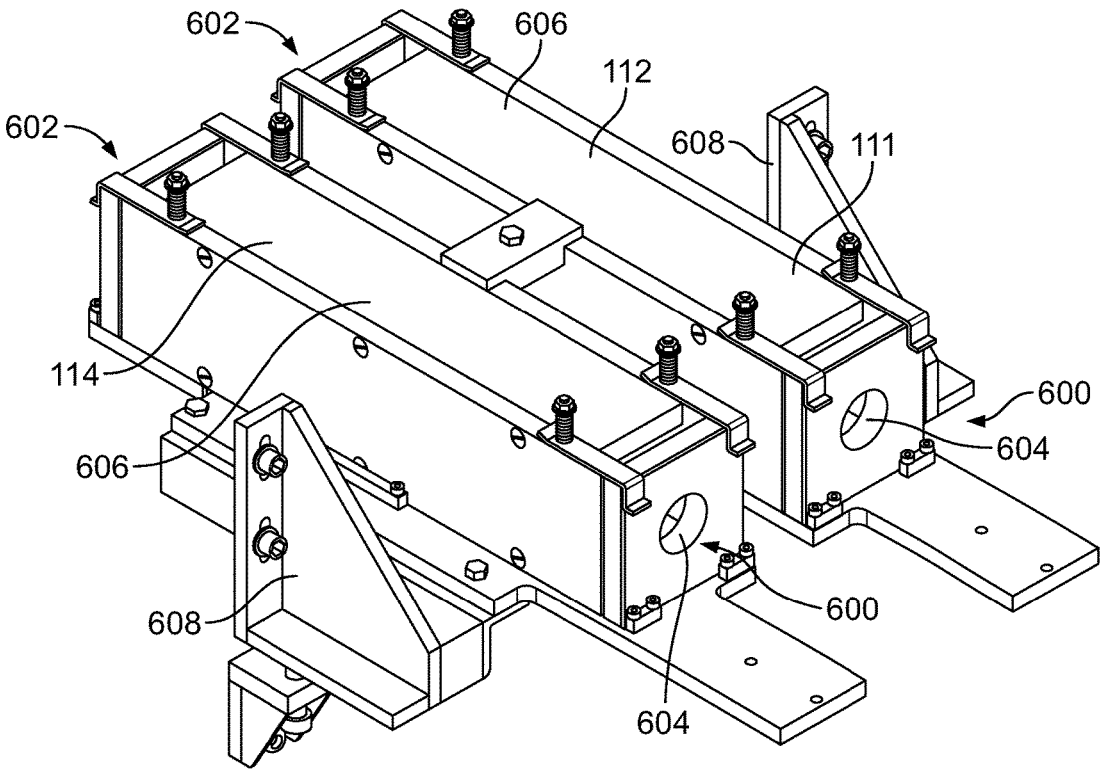
FIG. 6 illustrates a perspective view of an induction heater assembly 111 in accordance with the present teachings.
Figure 7:
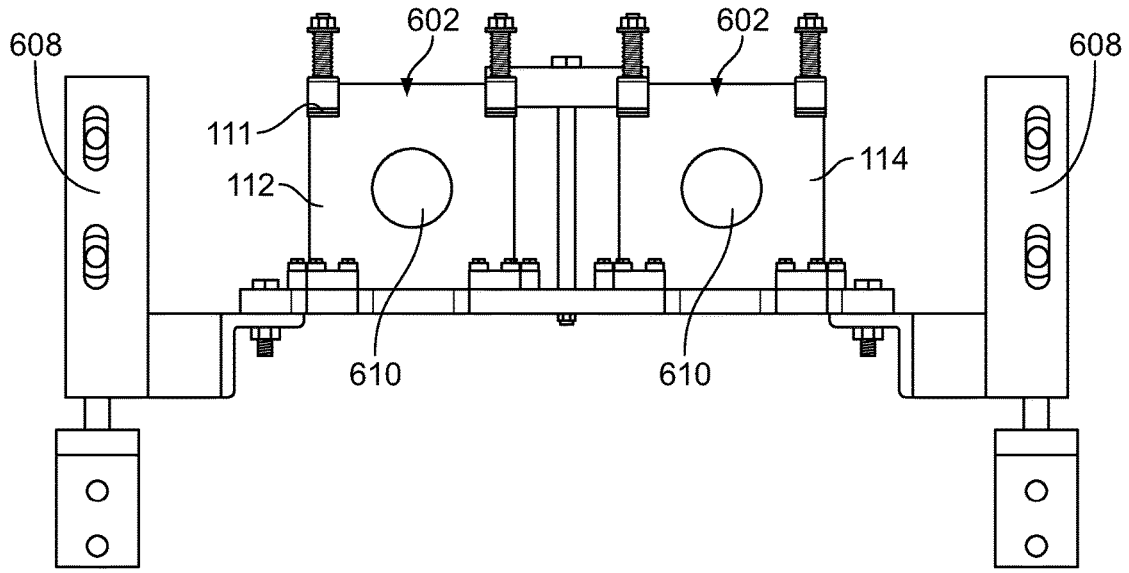
FIG. 7 illustrates a plan view of the induction heater assembly 111.

With reference to FIGS. 6 and 7, the induction heater assembly 111 can have two induction heaters 112, 114. Each induction heater 112, 114 can have an input end 600 and workpiece discharge end 602. At the input end 600, the induction heaters 112, 114 can have an inlet aperture 604 that can allow workpieces to enter induction heater housing 606. The heater housings 606 can contain induction heater coils and a pyrometer to measure the temperature of the workpieces. According to one aspect of the present teachings, the pyrometer can be positioned within the housing 606 and adjacent discharge end 602. The induction heater assembly 111 is secured to the housing 106 with brackets 608. In the forging press 100 shown in FIG. 1, each of the two induction heaters 112, 114 can be fed workpieces into its inlet aperture 604 by one of the feeders 108, 110. Workpieces can exit the induction heaters 112, 114 serially through outlet apertures 610.

Figure 8:
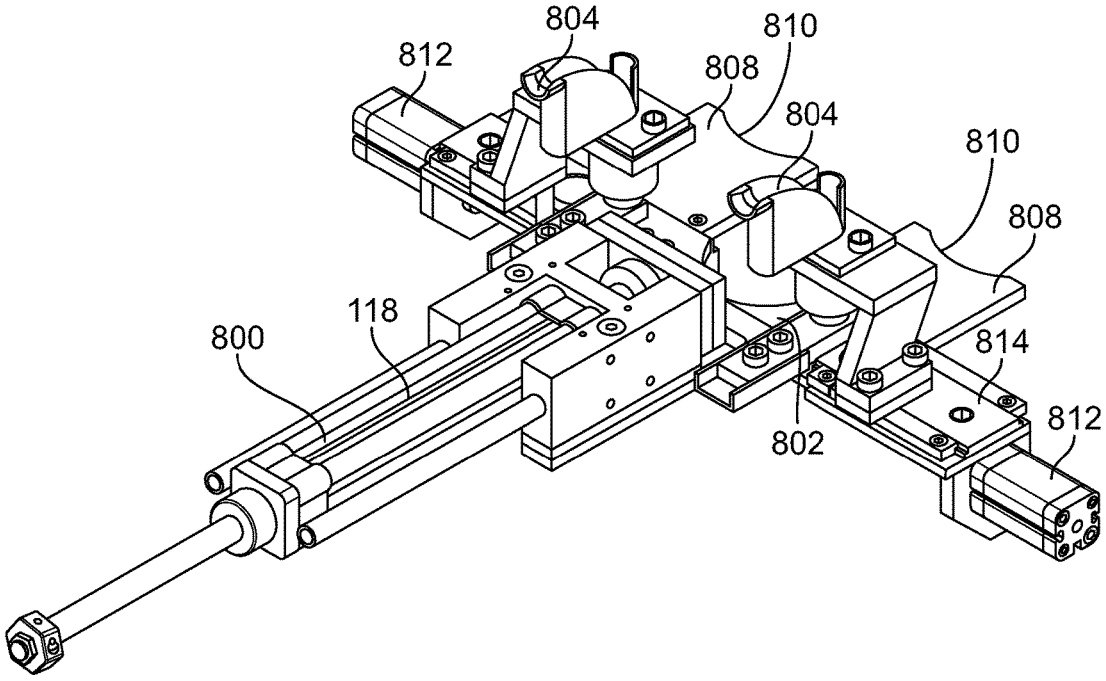
FIG. 8 illustrates a perspective view of a feeder 118 in accordance with the present teachings.
Figure 9:
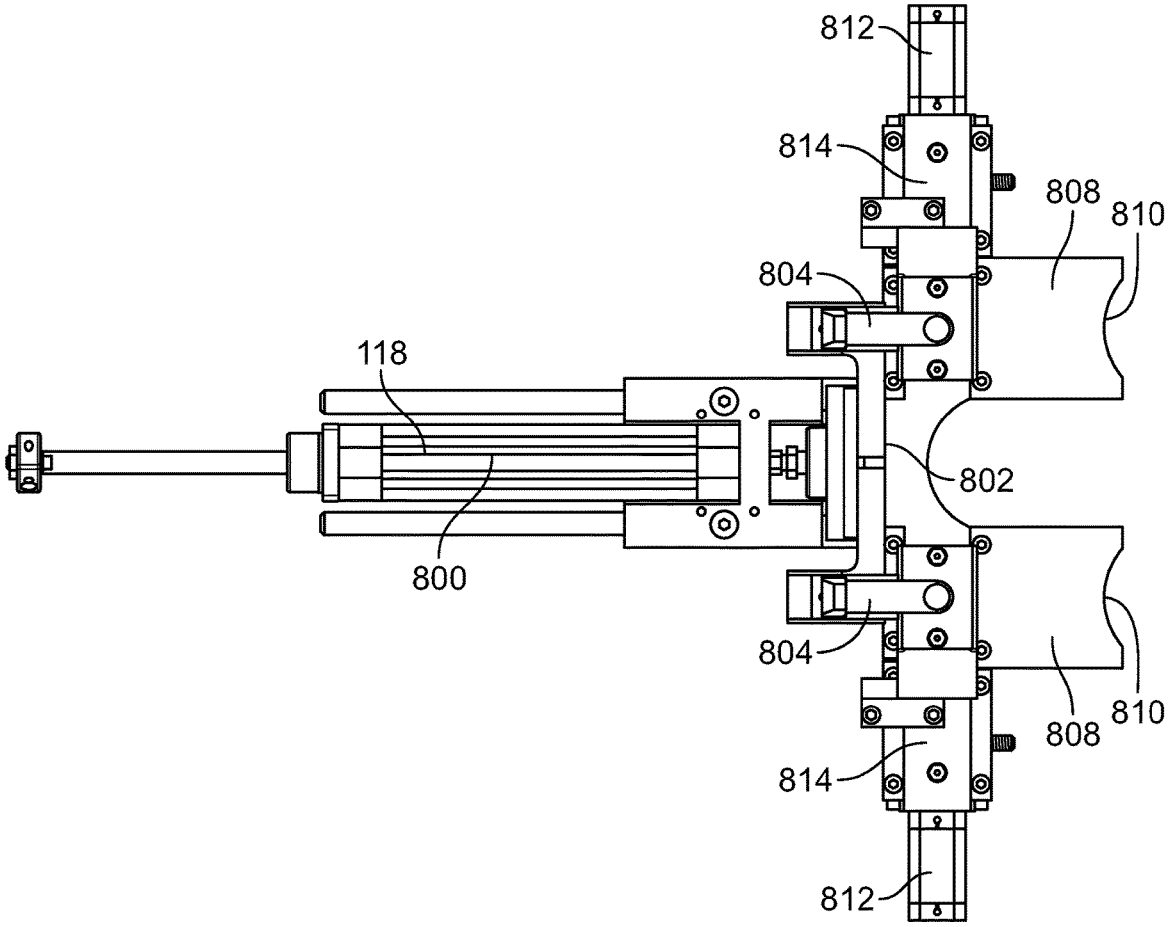
FIG. 9 illustrates a plan view of the feeder 118.
Figure 10:
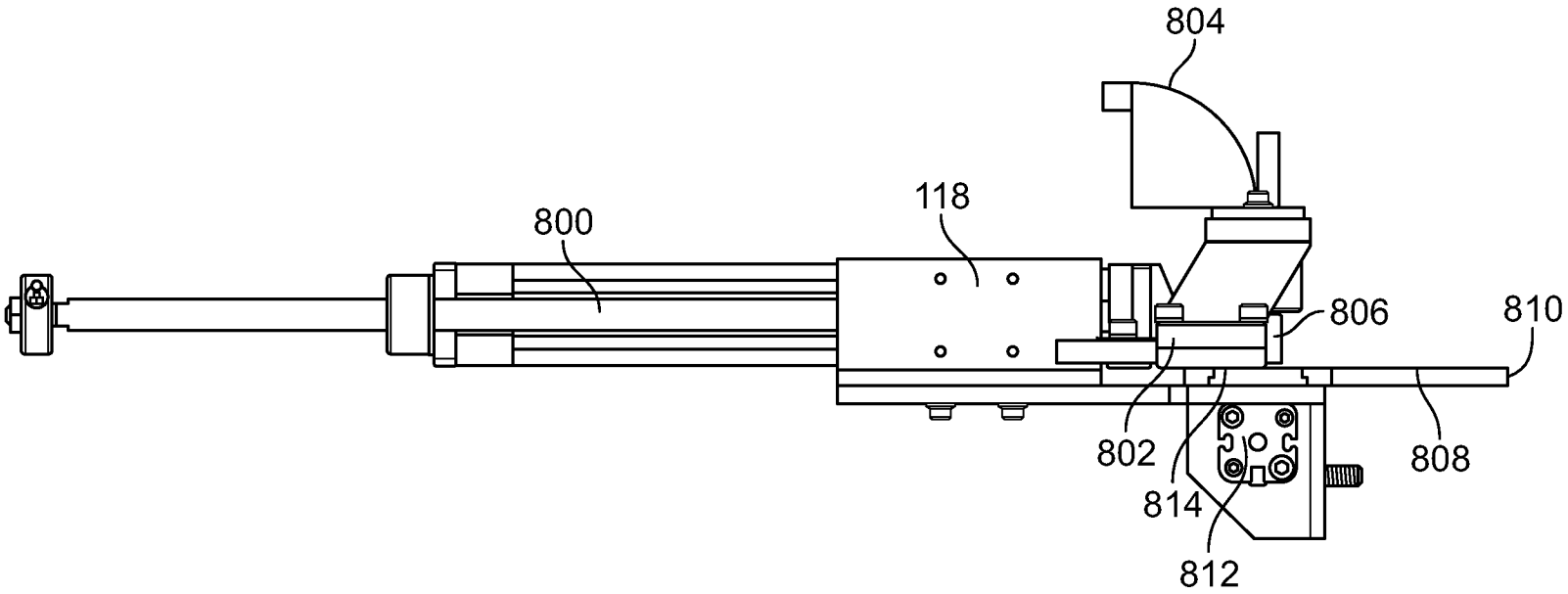
FIG. 10 illustrates an elevation view of the feeder 118.

With reference to FIGS. 8, 9 and 10, a die feeder 118 can have an actuator 800 that can move the arm 802 between the workpiece discharge end 602 of the induction heaters 112, 114 and the first station dies 122. Ramps 804 can be positioned to receive heated workpieces from the inductions heaters 112, 114. The workpieces can fall into receptacles 806 and can be supported underneath by trays 808. The actuator 800 can move the arm 802 into position such that the receptacles 806 can be over the first station dies 122, at which point the workpieces have traveled past edges 810, and are thus no longer supported underneath by trays 808 and drop into the first station dies 122. A portion 814 of each of the trays 808 can also be withdrawn by one of the tray actuators 812. These tray portions 814 are positioned underneath the receptacle 806 when the receptacle 806 is beneath the workpiece discharge end 602 in position to receive a workpiece from one of the induction heaters 112, 114. When a tray actuator 812 withdraws a tray portion 814, the workpiece can drop out of the receptacle 806 and into the sorter 126. According to one aspect of the present teachings, the tray actuator 812 can withdraw a tray portion 814 depending on the temperature measured by a pyrometer. Such a pyrometer can be housed within housing 606 adjacent to the discharge end 602 of the induction heaters 112, 114. For example, the tray actuator 812 can withdraw the tray portion 814 when the workpiece supported by the tray 808 has not reached sufficient temperature or rises to undesirably high temperatures. Such workpieces can be discharged to a sorter 126 as described further herein.

Figure 11:
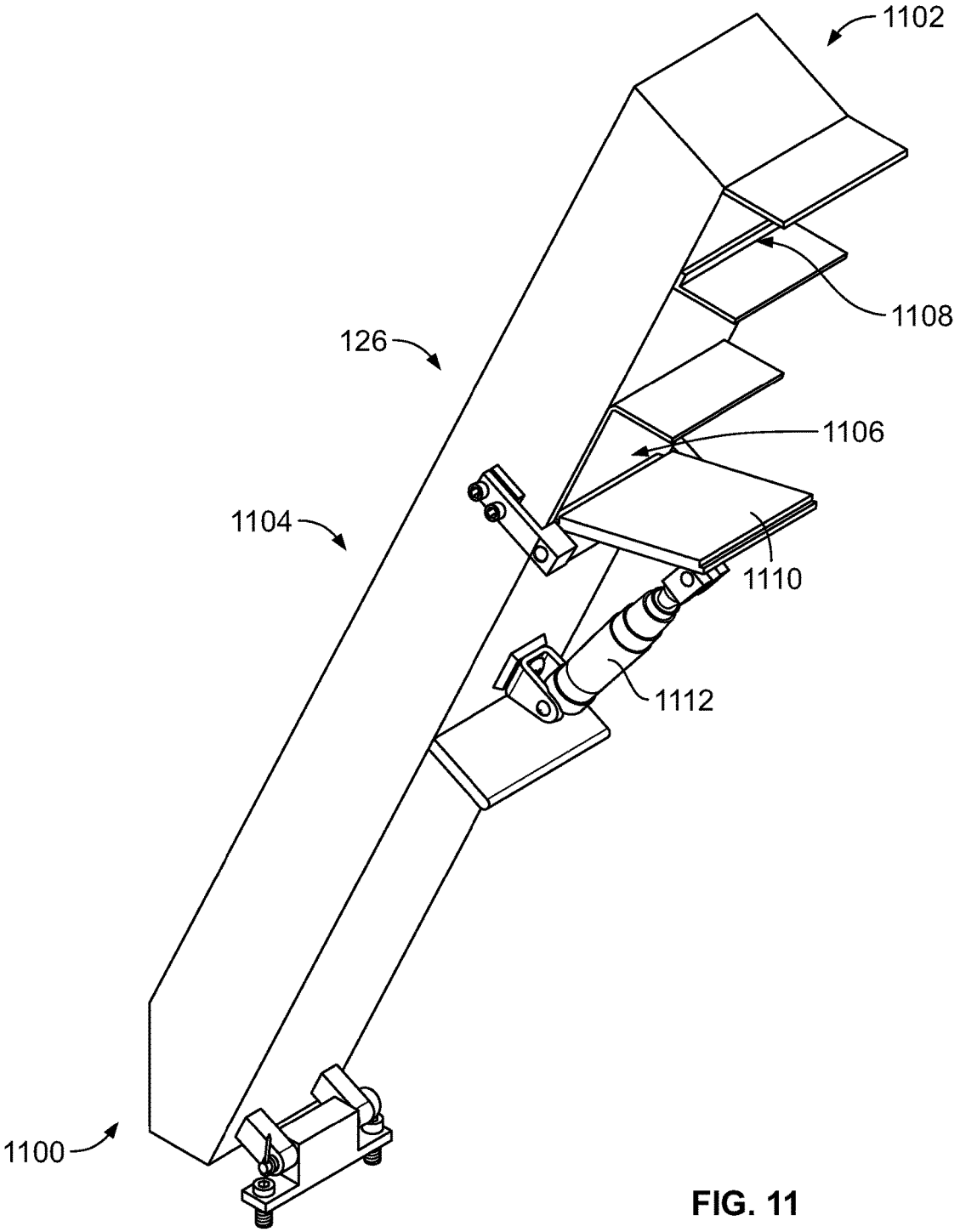
FIG. 11 illustrates a perspective view of a sorter 126 in accordance with the present teachings.
Figure 12:
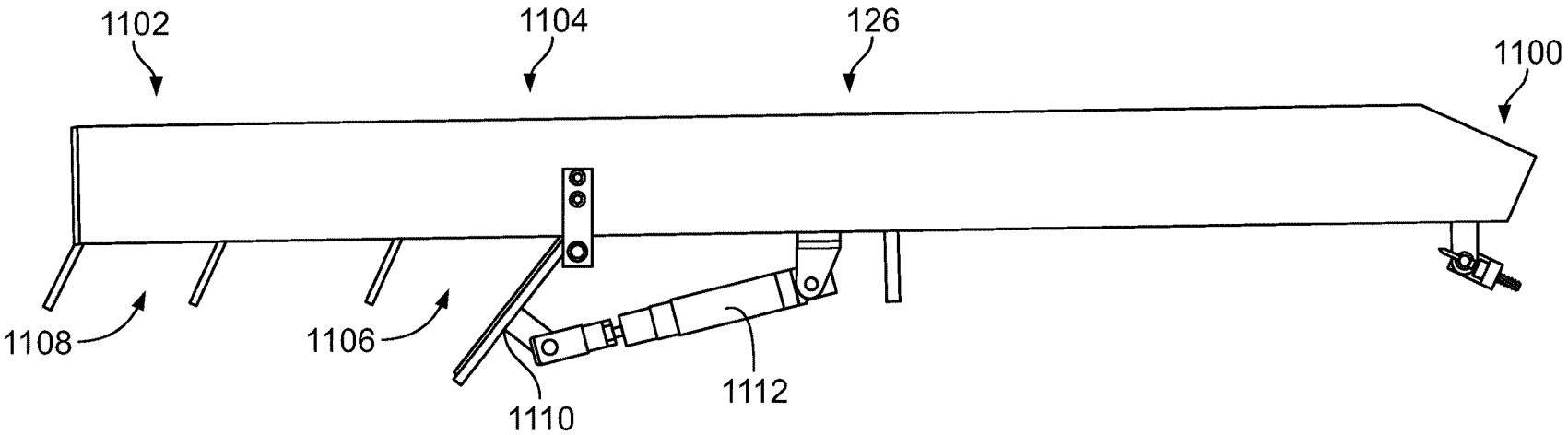
FIG. 12 illustrates an elevation view of the sorter 126.
Figure 13:
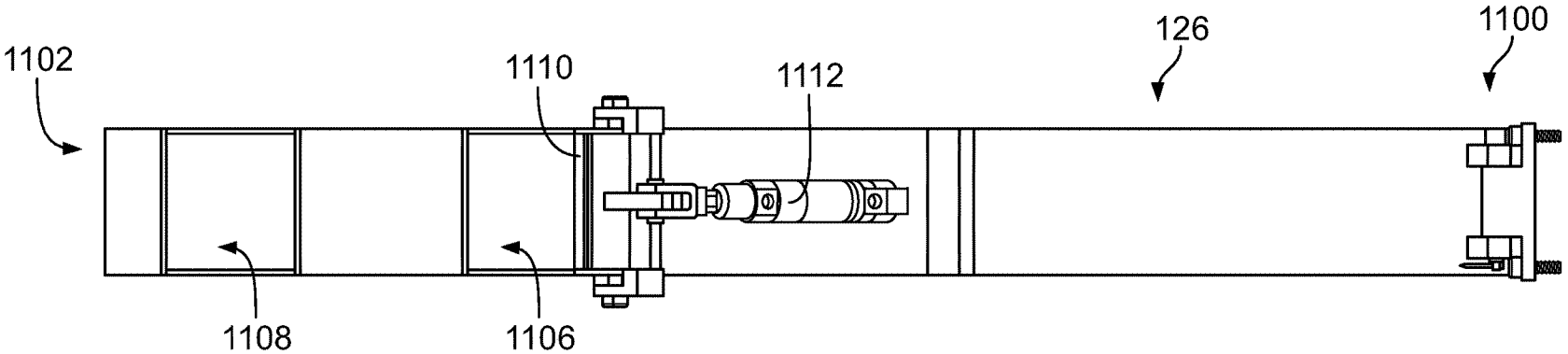
FIG. 13 illustrates an plan view of the sorter 126.

With reference to FIGS. 11, 12 and 13, the sorter 126 has a first end 1100 and a second end 1102. When mounted to the press 100, the first end 1100 of the sorter 126 can be elevated relative to the second end 1102. This permits workpieces that enter a chute 1104 at the first end 1100 to fall to the second end 1102.

The chute 1104 has two openings 1106, 1108. One opening 1106 can be disposed at the second end 1102 of the sorter 126. The other opening 1108 can be disposed closer to the discharge end 602 of the induction heaters 112, 114 under which the sorter 126 can be mounted. The opening 1108 that can be configured to be closer to the discharge end 602 can be selectively closed by a door 1110 through an actuator 1112. The actuator 1112 can for example selectively open the door 1110 when an overheated workpiece enters the chute 1104, which in turn can allow the workpiece to travel through the opening 1108. When an underheated part enters the chute 1104, the actuator 1112 can close the door 1110, forcing the underheated part to continue past the door 1110 to the opening 1108.

Figure 14:
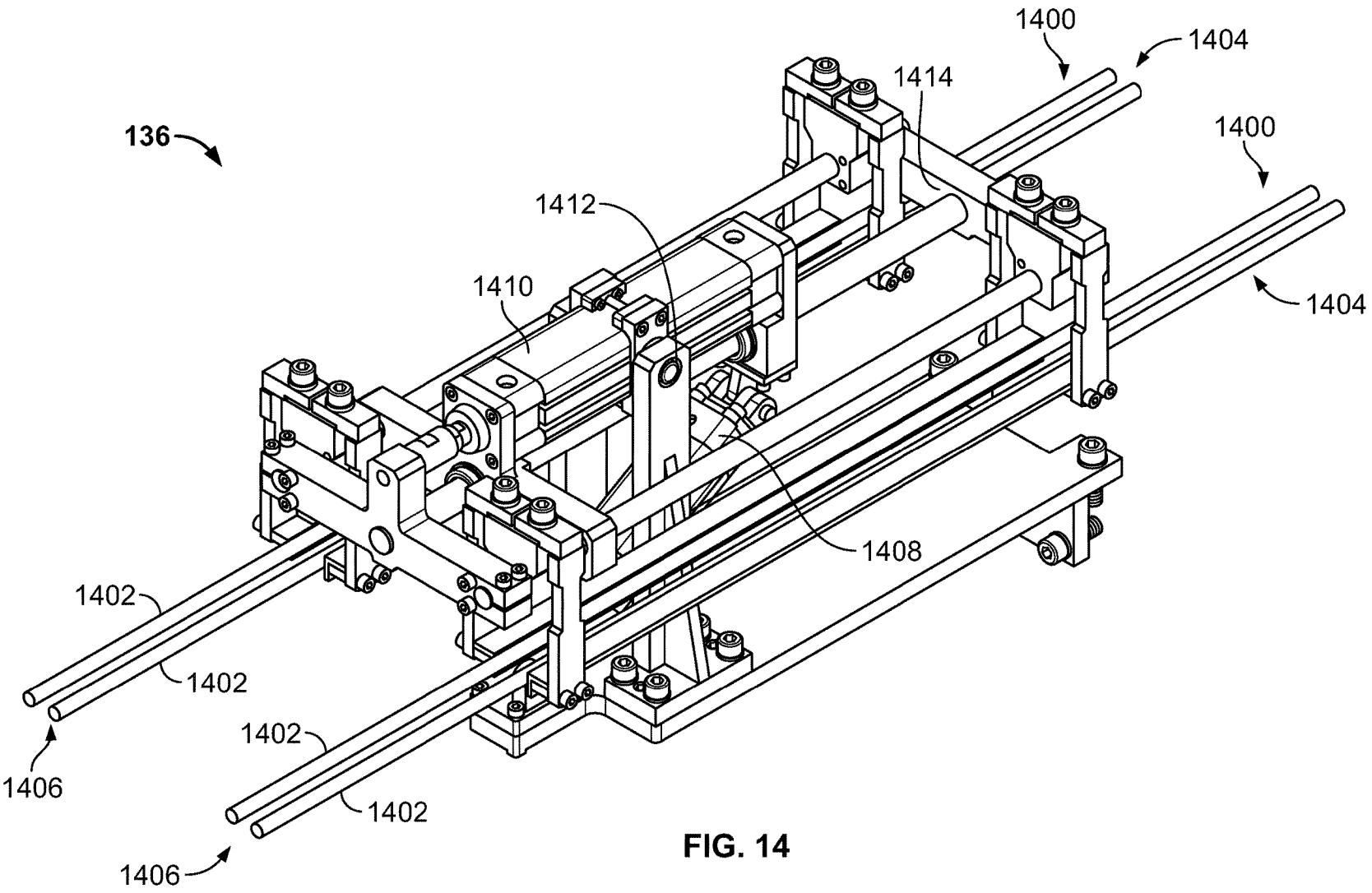
FIG. 14 illustrates a plan view of a discharger 136 in accordance with the present teachings.
Figure 15:
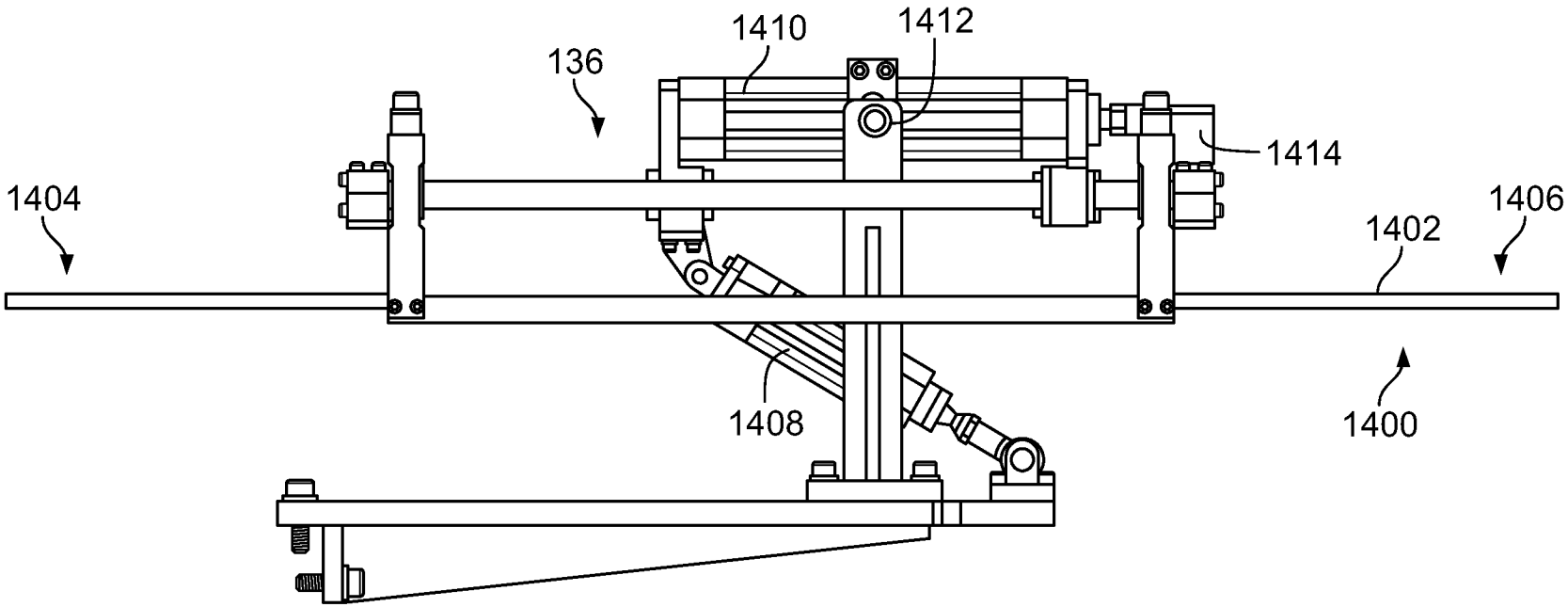
FIG. 15 illustrates an elevation view of the discharger 136.
Figure 16:
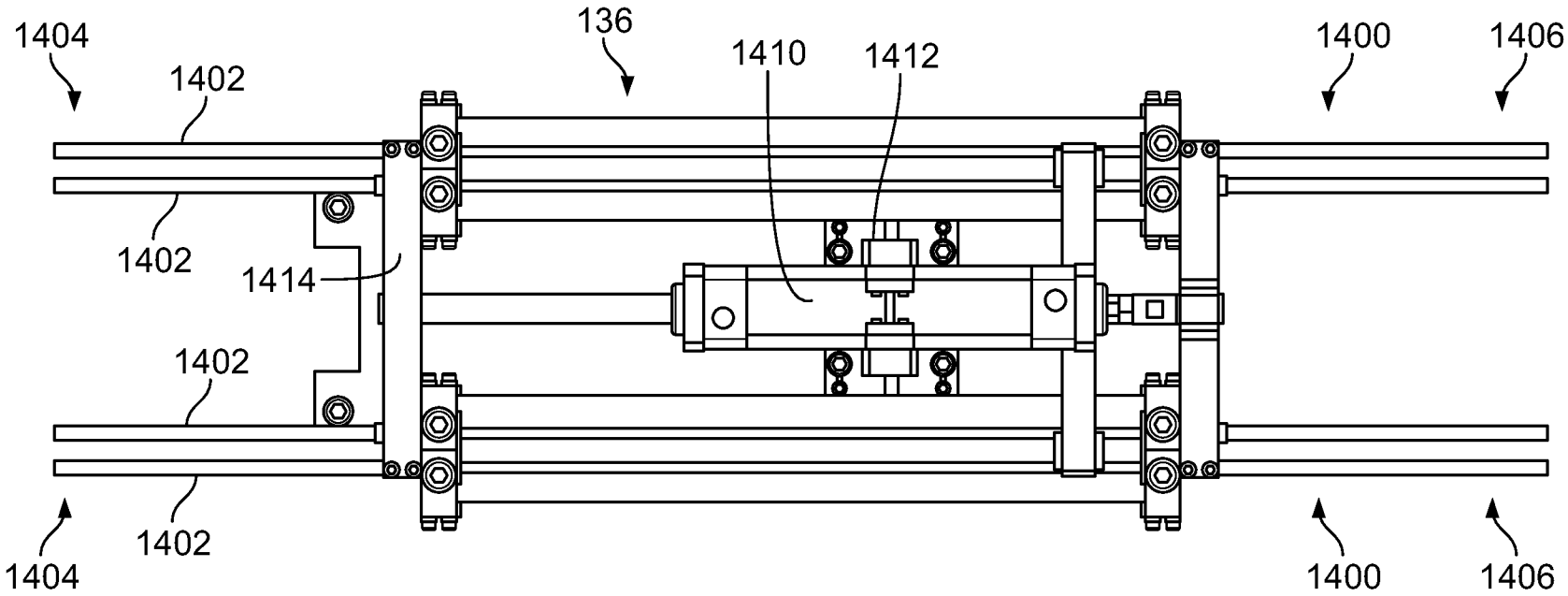
FIG. 16 illustrates a plan view of the discharger 136.

With reference to FIGS. 14, 15 and 16, a dual discharger 136 can have arms 1400. Each of the arms 1400 can include two parallel rods 1402 spaced apart a constant distance from one another at each point from an input end 1404 to an output end 1406. A pivoting actuator 1408 can pivot an arm actuator 1410 about an axle 1412. A frame 1414 can hold the rods 1402. Both the frame 1414 and the rods 1402 can pivot along with the arm actuator 1410. The arm actuator 1410 can move the arms reciprocally in a direction parallel to the linear rods 1402.

Figure 17:
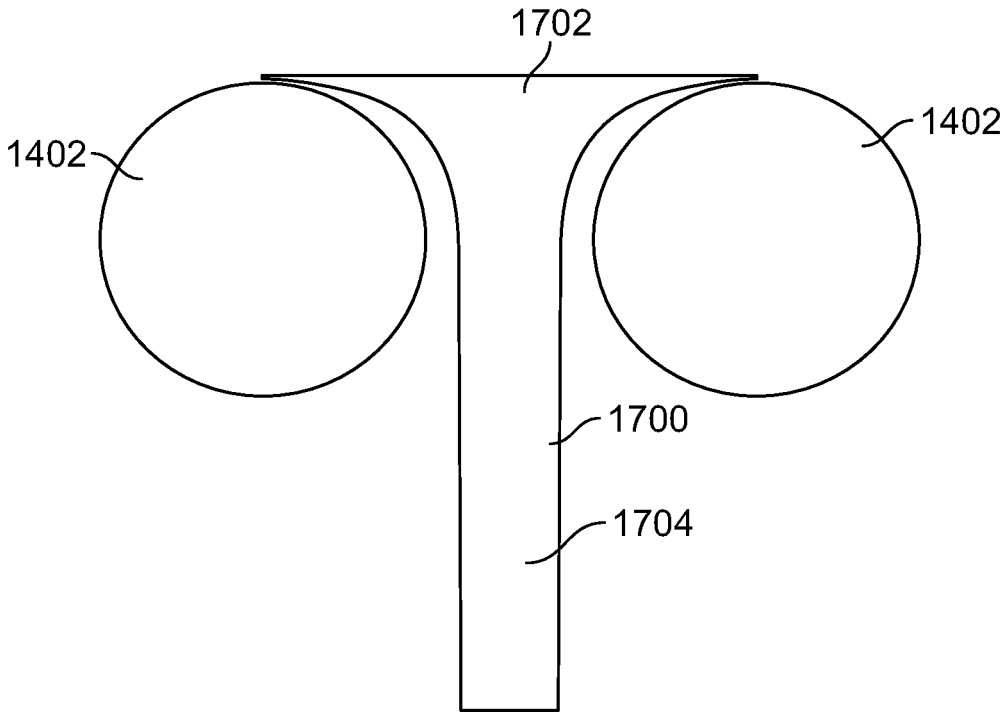
FIG. 17 shows the cross-sectional of a workpiece 1700 held by rods 1402.
Figure 18:
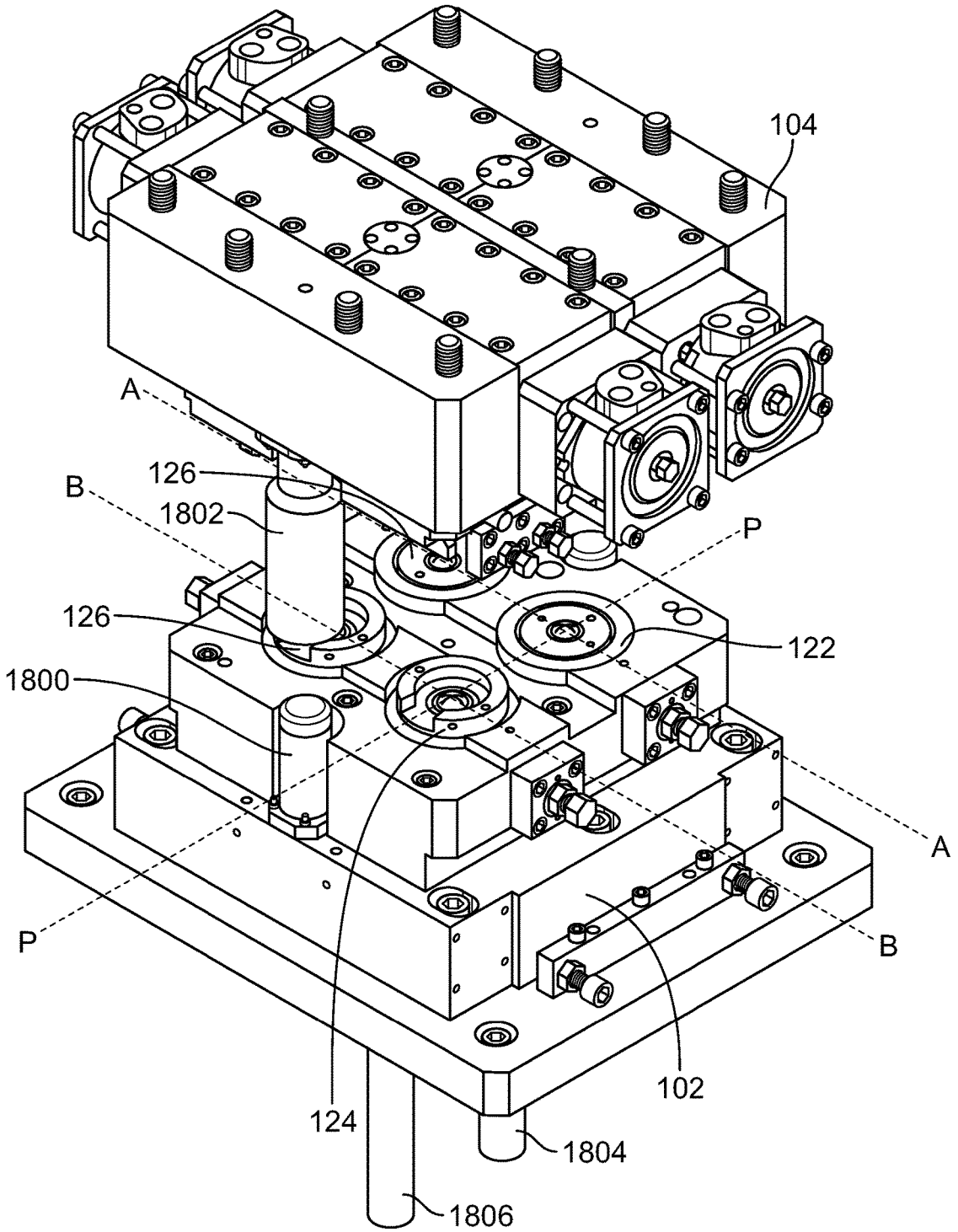
FIG. 18 illustrates a perspective view of an anvil 102 and a press head 104 in accordance with the present teachings.
Figure 19:
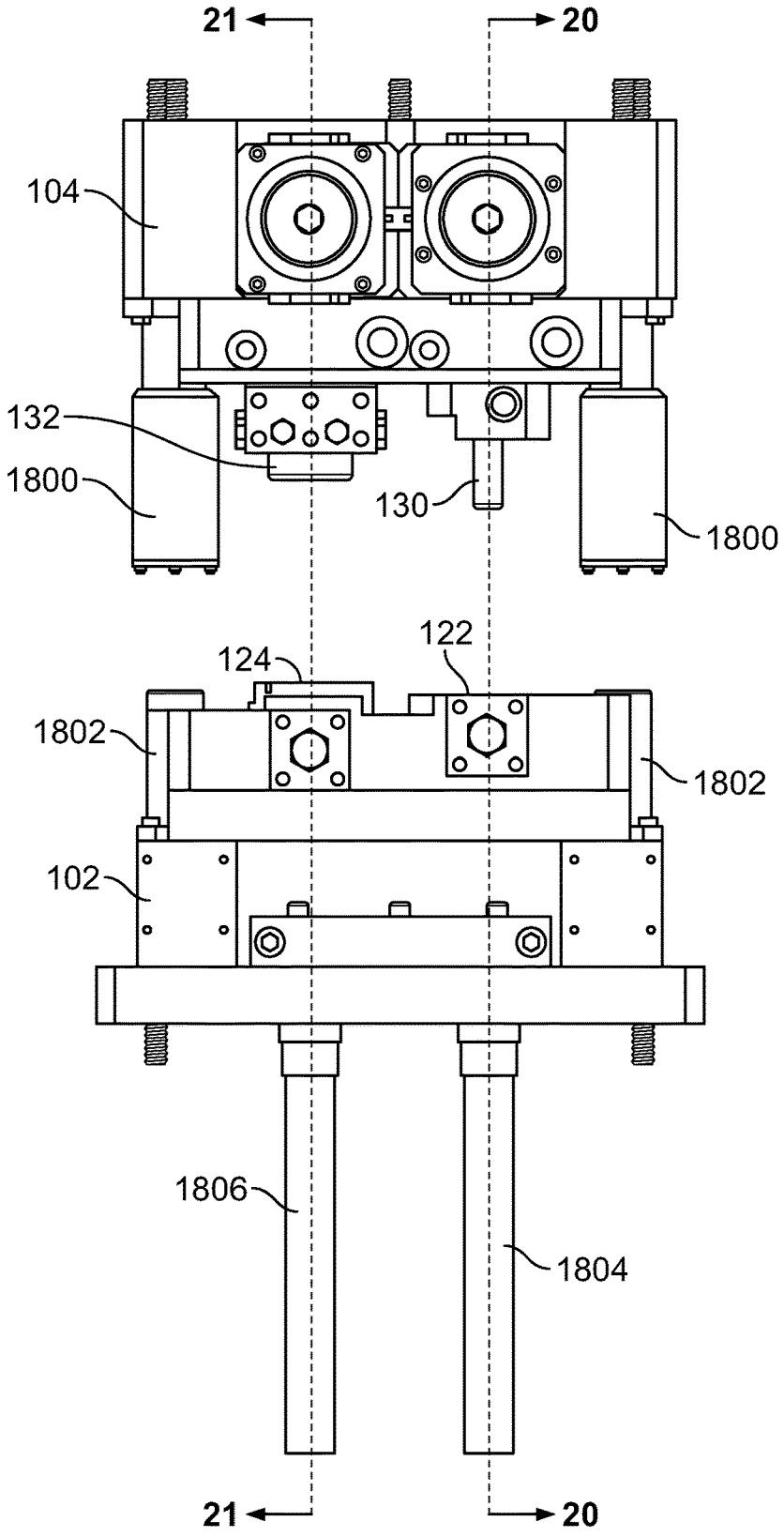
FIG. 19 illustrates an elevation view of the anvil 102 and the press head 104.
Figure 20:
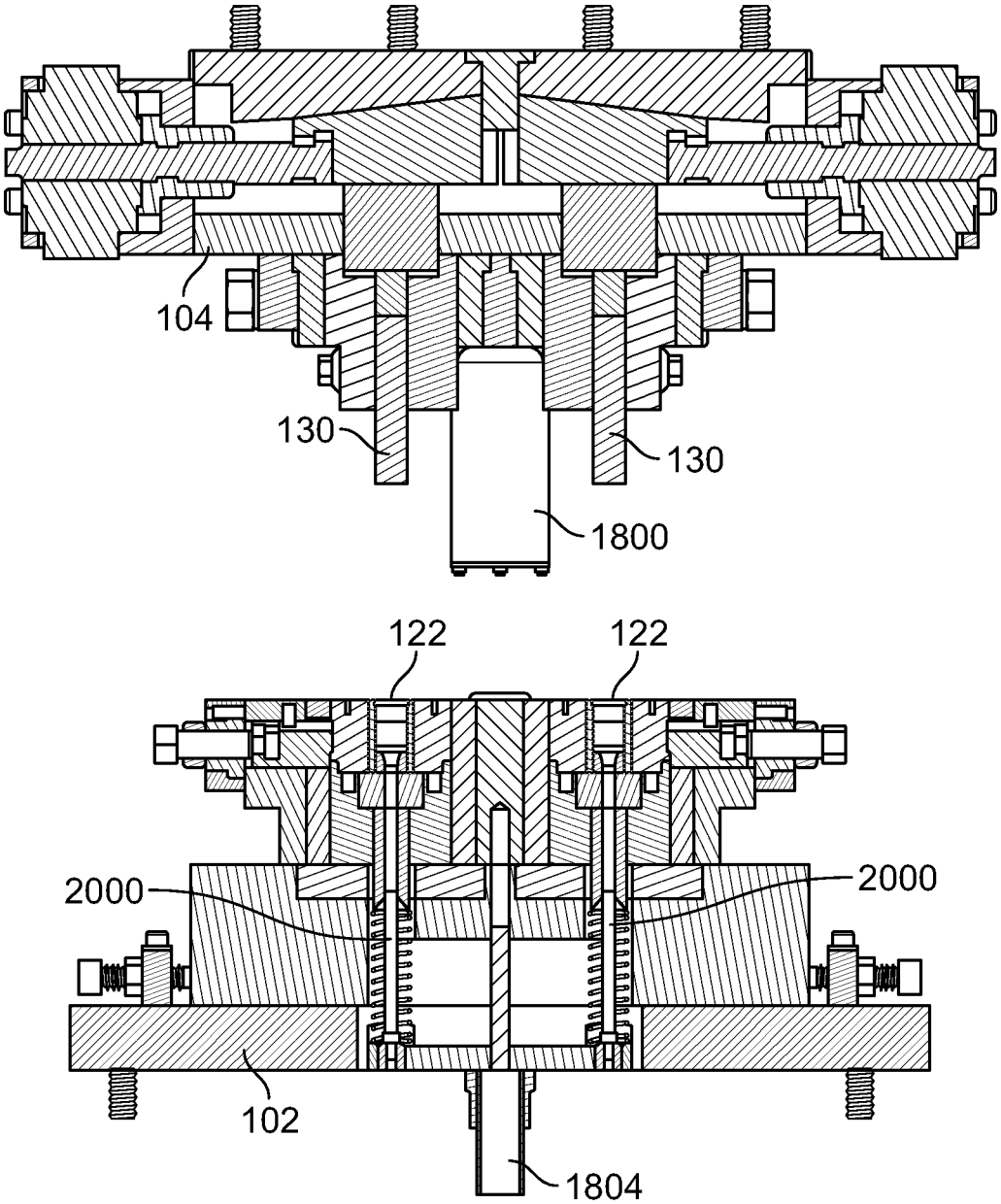
FIG. 20 illustrates a sectional view of the anvil 102 and the press head 104 along the line 20-20 shown in FIG. 19.
Figure 21:
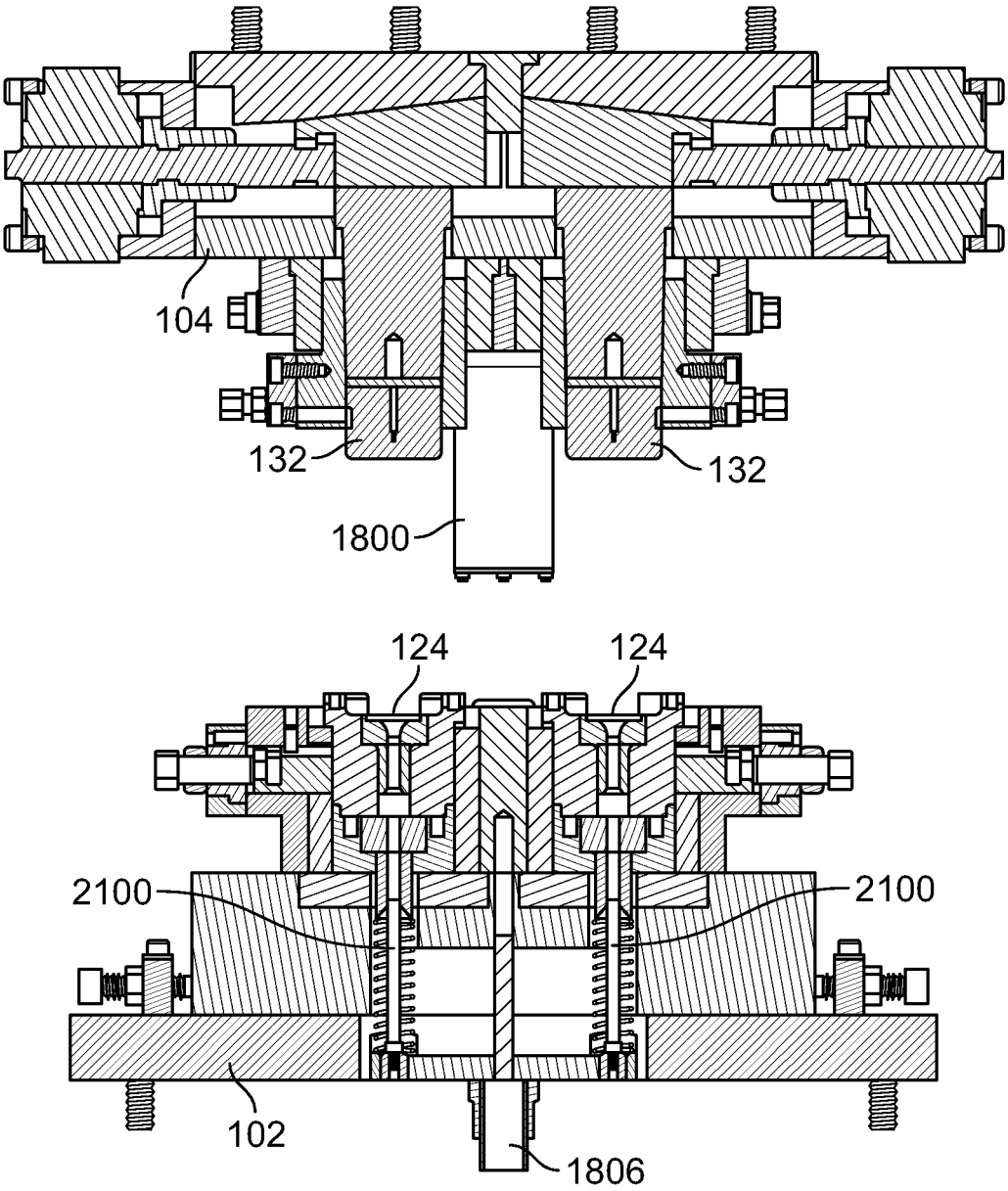
FIG. 21 illustrates a sectional view of the anvil 102 and the press head 104 along the line 21-21 shown in FIG. 19.

With reference to FIG. 17, a workpiece 1700 formed in the second station dies 124 are engine valves having a wide head 1702 which joins a shaft 1704. The rods 1402 can suspend the workpiece 1700 by the head 1702. This arrangement can permit the workpiece 1700 to slide along rods 1402 when they are tilted from a horizontal position.

According to one aspect of the present teachings, when mounted to the forging press 100, the arm actuator 136 can move the arms 1400 toward the second forming stations 124 where the input end 1404 of the arms 1400 move underneath the valve head 1702 shown in FIG. 17. The pivoting actuator 1408 can lift the workpiece upwardly, and can also tilt the rods 1402 so that the input end 1404 can be above the output end 1406. The workpieces 1700 can slide along the rods 1402 toward the output end 1406, at which point the workpieces 1700 can slide off the rods 1402, for example into a bin for further processing. The arm actuator 1410 can then retract the arms 1400 in advance of another cycle of forming workpieces into valves in the second forming stations 124.

With reference to FIGS. 18, 19, 20 and 21, the press head 104 can include guide sleeve 1800. The guide sleeve 1800 can fit over guide pin 1802 as the press head 104 lowers onto the anvil 102, ensuring alignment of the press head 104 with the anvil 102. According to one aspect of the present teachings, the first station dies 122 can lie along line A. According to another aspect of the present teachings, the second station dies 124 can lie along line B. The progression of workpieces through the first station dies 122 and second station dies 124 can follow a line parallel to line P. A line passing through each first station die 122 and its corresponding second station die 124 can be parallel to line P. Line P can be perpendicular to both lines A and B.

According to yet other aspects of the present teachings, three or more sets of first station dies, for example the first station dies 122 illustrated herein, may be used to simultaneously form a plurality of workpieces having a particular form. In another aspect of the present teachings, the plurality of first station dies has a common mold shape, such that the dies form a workpiece having a common shape. In yet another aspect of the present teachings, three or more sets of second station dies, such as the second station dies 124 illustrated herein, may be used to simultaneously form a plurality of workpieces received from the plurality of first station dies.

The first station dies 122 can be positioned beneath the pin 130. During operation of the press 100, the pin 130 can descend on a workpieces deposited in first station dies 122. The workpiece is extruded to a particular shape complementary to the first station die 122. Once the workpiece is extruded in the first station dies 122 and the press head 104 lifts off of the anvil 102, the extraction arm 1804 can be pushed upwardly toward the workpieces and can cause rods 2000 to dislodge the workpieces from the first station dies 122. The workpieces can be transferred from the first station dies 122 to the second station dies 124, for example with a robotic mechanism that grabs the workpieces and moves them to the second station dies 124.

The second station dies 124 can be positioned beneath restriking pin 132. Restriking pin 132 can descend on the workpieces that have been formed in the first station dies 122 and moved into the second station dies 124. The workpiece is formed to its final forged shape, which is complementary to the shape of the second station die 124. Once the workpiece is forged and the press head 104 lifts off of the anvil 102, the extraction arm 1806 can be pushed upwardly toward the workpieces and causes rods 2100 to dislodge the workpieces from the second station dies 124.

Figure 22:
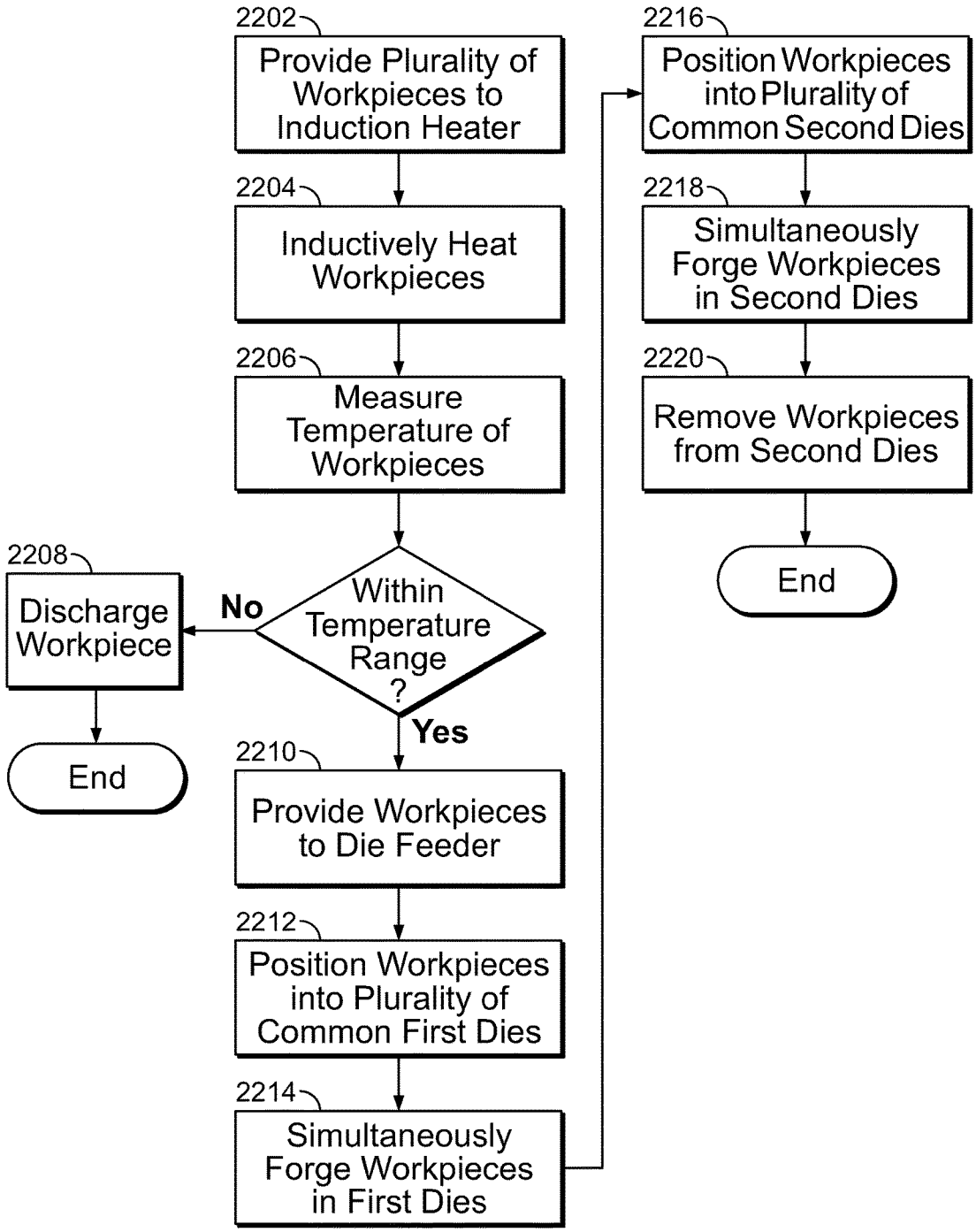
FIG. 22 illustrates method 2200 of forging workpieces in accordance with the present teachings.

FIG. 22 illustrates a diagram of a method 2200 of forging workpieces according to one aspect of the present teachings. In block 2202, workpieces can be fed into at least one induction heater. In one aspect of the present teachings, two induction heaters are used. In block 2204, the workpieces can be heated by the induction heaters. In block 2206, the temperature of the workpieces can be measured. Depending on whether measured temperature is within an acceptable temperature range or not, the workpiece can either be discharged as done in block 2208, for example by discharging the workpiece into a chute for collection and further processing, or can be provided to the die feeder 118 in block 2210. According to one aspect of the present teachings, a die feeder 118 such as that described herein having two workpiece receptacles 806 can be used to supply workpieces simultaneously to a plurality of first station dies 122 having a common die shape, for example as done in block 2212. In block 2214, the workpieces in the first station dies can be formed simultaneously, such as occurs when the forging press 100 forms workpieces in the first station dies 122. In block 2216, the workpieces formed in block 2212 can be provided to a plurality of second station dies having a common die shape. In block 2216, the workpieces formed in the second station dies can be removed from the second station dies. Such removal can be performed, for example, by discharger 136.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." As used herein, "about" will be understood by persons skilled in the art and will vary to some extent depending upon the context in which it is used. If there are uses of the term which are not clear to persons skilled in the art, given the context in which it is used, "about" will mean up to plus or minus 10% of the particular term. From about A to B is intended to mean from about A to about B, where A and B are the specified values.

While the present disclosure illustrates various aspects of the present teachings, and while these aspects have been described in some detail, it is not the intention of the applicant to restrict or in any way limit the scope of the claimed invention to such detail. In light of the disclosure, additional advantages and modifications will be apparent to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing aspects of the present teachings are illustrative, and no single feature or element is essential to all possible combinations that may be claimed in this or a later application.

The invention claimed is:

1. A method comprising:

heating a plurality of forgeable workpieces with at least one induction heater having a workpiece discharge end;

moving an arm of a die feeder into a first position adjacent the respective workpiece discharge ends such that workpieces exiting the workpiece discharge end are received by respective receptacles of the arm and are supported by trays;

moving the arm of the die feeder into a second position wherein the workpieces are unsupported by the trays and drop into a respective plurality of first station dies;

applying pressure simultaneously to the forgeable workpieces until the forgeable workpieces have a first shape; and transferring each of the forgeable workpieces to one of a plurality of second forming stations having a second common die shape.

2. The method of claim 1, further comprising:

upon depositing each of the forgeable workpieces in the second stations, applying pressure simultaneously to the forgeable workpieces until the forgeable workpieces have a second shape.

3. A method comprising:

inductively heating a plurality of forgeable workpieces with at least one induction heater having a workpiece discharge end;

receiving the forgeable workpieces from the workpiece discharge end at receptacles defined on an arm of a die feeder, the workpieces supported by trays;

moving the arm to a position where the workpieces are unsupported by the trays causing the respective workpieces to be deposited in one of a plurality of first forming stations having a first common die shape;

upon depositing the forgeable workpieces in the first stations, applying pressure simultaneously to the forgeable workpieces until the forgeable workpieces have a first shape;

transferring each of the forgeable workpieces to one of a plurality of second forming stations having a second common die shape; and upon depositing each of the forgeable workpieces in the second stations, applying pressure simultaneously to the forgeable workpieces until the forgeable workpieces have a second shape.

4. The method of claim 3 further comprising:

measuring the temperature of each of the forgeable workpieces before the depositing of the forgeable workpieces.

5. The method of claim 3, wherein the transferring of the forgeable workpieces to the second forming stations displaces each of the forgeable workpieces along a line parallel to a progression axis.

6. The method of claim 3, wherein the first forming stations are positioned along a first line.

7. The method of claim 6, wherein the second forming stations are positioned along a line parallel to the first line.

* * * * *